United States Patent [19]

Wesley et al.

[11] Patent Number: 4,479,680

[45] **Date of Patent: * Oct. 30, 1984**

[54] METHOD AND APPARATUS FOR ELECTROHYDRAULIC FRACTURING OF ROCK AND THE LIKE

[76] Inventors: Richard H. Wesley, 19511 Ricelake La., Houston, Tex. 77084; Richard A. Ayres, 10801 DeWitt Ct., El Cajon, Calif. 92020

[ * ] Notice: The portion of the term of this patent subsequent to Aug. 24, 1999 has been disclaimed.

[21] Appl. No.: 407,066

[22] Filed: Aug. 11, 1982

Related U.S. Application Data

[63] Continuation-in-part of Ser. No. 139,438, Apr. 11, 1980, Pat. No. 4,345,650.

[51] Int. Cl.[3] ..... E21C 37/18; E21B 37/08

[52] U.S. Cl. ..... 299/14; 166/249; 166/299; 166/308; 166/311

[58] Field of Search ..... 299/14, 16; 175/16; 166/65 R, 249, 271, 299, 308, 311

[56] References Cited

U.S. PATENT DOCUMENTS

| | | | |
|---|---|---|---|
| 3,116,449 | 12/1963 | Vogel | 166/177 UX |
| 3,118,418 | 4/1965 | MacLeod | 166/177 X |
| 3,500,942 | 3/1970 | Smith, Jr. | 175/16 |
| 3,544,165 | 12/1970 | Snedden | 175/16 X |
| 3,708,022 | 1/1973 | Woodruff | 175/16 |
| 4,074,758 | 2/1978 | Scott | 166/249 |
| 4,164,978 | 8/1979 | Scott | 166/249 |
| 4,169,503 | 10/1979 | Scott | 166/249 X |
| 4,343,356 | 8/1982 | Riggs et al. | 166/311 X |
| 4,345,650 | 8/1982 | Wesley | 166/249 |

OTHER PUBLICATIONS

Sarapuu, "Electro-Energetic Rock Breaking Systems", *Mining Congress Journal,* Jun. 1973, pp. 44–54.

*Primary Examiner*—George A. Suchfield
*Attorney, Agent, or Firm*—Gunn, Lee & Jackson

[57] ABSTRACT

Electrohydraulic fracturing of rock and other dense materials is accomplished by coupling a hydraulic medium to the material to be fractured and inducing an explosive electrical discharge in the coupling medium in close proximity to the dense material thus developing an electrohydraulic shock wave in the coupling medium. This shock wave is transmitted into the rock or other dense material as an advancing compressive strain pulse which radiates from the explosive electrical discharge through the dense material until it is reflected by a free surface as a tensile strain pulse. The tensile strain pulse is impedance matched with the dense material to be fractured such that the tensile strain pulse induces in situ fracturing of the dense material. A motor driven generator system which provides alternating current to a control unit which incorporates a transformer and diode controlled bridge rectifier system providing stepped up DC voltage. The DC voltage is stored in a capacitor bank and is subsequently discharged through an exploding wire element or spark gap to develop the explosive electrical discharge.

5 Claims, 3 Drawing Figures

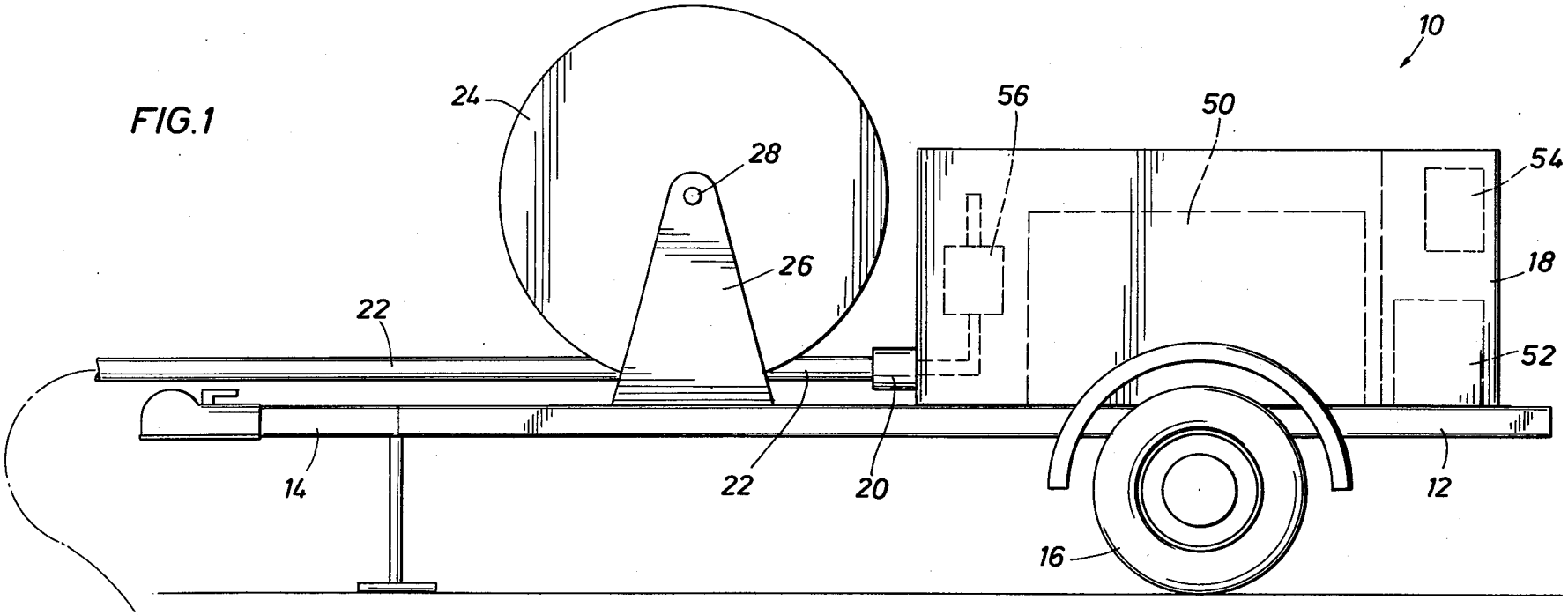
FIG.1
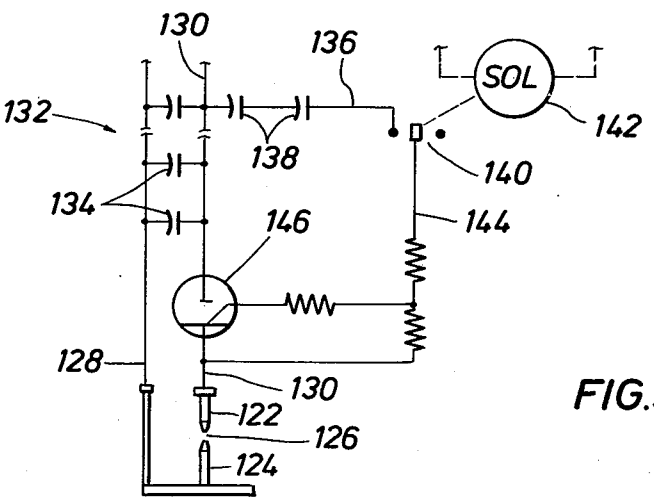
FIG.3
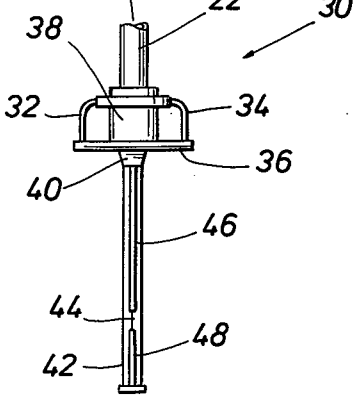

METHOD AND APPARATUS FOR ELECTROHYDRAULIC FRACTURING OF ROCK AND THE LIKE

This is a continuation-in-part of the subject matter set forth in U.S. patent application Ser. No. 139,438, filed Apr. 11, 1980, now U.S. Pat. No. 4,345,650, and entitled PROCESS AND APPARATUS FOR ELECTROHYDRAULIC RECOVERY OF CRUDE OIL.

FIELD OF THE INVENTION

This invention relates generally to a method for controlled in situ fracturing of rock concrete and other such dense materials at shallow depths and more particularly concerns a method for accomplishing electrohydraulic fracturing of such dense materials and utilization of an electrohydraulic fracturing process for cleaning of dense fracturable material from mechanical structures. This invention also concerns technology relating generally to portable apparatus for controlled in situ fracturing of rock material such as in shallow, small diameter holes, pipes, etc., and the controlled use of electrohydraulic energy to fracture rock, cement, concrete, or other similar dense materials for which removal is generally desired on construction sites and the like.

BACKGROUND OF THE INVENTION

Heretofore, the most efficient method of removing rock formations from construction sites has been through utilization of chemical explosives which are detonated to accomplish fracturing of the rock material. The fractured rock material is then removed through the use of various mechanical apparatus of conventional nature. When chemical explosives are utilized in this manner, major safety considerations come into play and other factors such as high insurance, special licenses, special trucks and equipment for transporting caps and explosives become a necessity. Further, utilization of explosives for rock fracturing is typically limited by weather and other conditions which cannot be effectively controlled. Even further, utilization of explosives requires experienced personnel, thereby resulting in excessively high labor costs and other factors which have an adverse influence on the commercial success of the construction operation. It is desirable therefore to provide electrohydraulic method and apparatus for fracturing rock and other dense materials which effectively overcomes the disadvantages of chemical explosive type rock fracturing and provides the construction industry with an avenue for safe and efficient rock fracturing that may be employed without regard to weather and other such detrimental considerations. It is also desirable to also provide means for fracturing rock and other dense materials through utilization of low cost labor and eliminates the need for expensive considerations such as high insurance costs, special licenses, special transporting devices, etc.

THE PRIOR ART

Attention is directed to U.S. patent application Ser. No. 139,438 of Richard H. Wesley, for a Process and Apparatus for Electrohydraulic Recovery of Crude Oil by Means of Electrohydraulic Stimulation. Various methods of fracturing earth formations have been developed in the past as indicated by U.S. Pat. Nos. 2,871,943 of Bodine, Jr.; 3,302,720 of Brandon; 3,842,907 of Baker, et. al.; and 3,965,982 of Medlin. Oscillatory pressure waves have been introduced in earth formations such as indicated by U.S. Pat. No. 3,754,598 of Holloway, Jr. Electromechanical transducer apparatus has been employed to accomplish injection of sonic energy into earth formations as taught by U.S. Pat. No. 3,527,300. Ultrasonic stimulation of earth formations is taught by U.S. Pat. No. 3,990,512 of Kuris. Sonic wave generation in earth formations is also taught by U.S. Pat. Nos. 3,923,099 and 4,022,275 of Brandon. Hydraulic fracturing is taught by U.S. Pat. No. 3,743,017. Sonic wave stimulation of earth formations is taught by U.S. Pat. No. 4,060,128. Spark generated shock wave coating and impregnation of articles is taught by U.S. Pat. No. 3,220,873 of Wesley.

SUMMARY OF THE INVENTION

In the use which is contemplated by this invention and in order to overcome these disadvantages it is a primary objective of this invention to employ a spark discharge of relatively high energy in a shallow hole containing fluid for shock wave transmission, to fracture the rock.

It is a feature of the present invention to provide novel method and apparatus for accomplishing fracturing of dense materials such as rock, fracturable hard mineral deposits and the like by means of electrical spark energized electrohydraulic in situ fracturing.

It is another feature of this invention to provide novel apparatus for accomplishing fracturing of dense materials which may be of portable nature thereby being efficiently usable in field locations for fracturing surface rock.

It is also a feature of this invention to provide a novel method and apparatus for fracturing dense materials which may be effectively utilized under most weather conditions and which may be accomplished in safe and efficient manner by means of relatively unskilled, low-cost labor.

Among the several features of this invention is contemplated the provision of a novel method and apparatus for fracturing rock and other dense materials which may be utilized in mechanical cleaning processes and which may also be utilized to separate metal objects from various dense fracturable materials such as concrete, cement and the like.

In is an even further feature of this invention to provide a novel method and apparatus for fracturing dense materials and which is of simple nature, is reliable in use and low in cost.

In Situ Fracturing of Surface Rock

In the simplest form of the invention specifically for the fracturing of surface rock, apparatus is provided which consists of a trailer mounted capacitor bank with an accompanying reel for an electrical cable that will conducts electrical energy from the capacitor bank to the fracturing site. At the extremity of the electrical cable (150') is located an electrohydraulic energy detonation tool which is inserted in a predrilled shallow hole in the rock formation. An initiating filament is located at the end of the tool to more completely utilize the electrical energy. With the tool in place in the predrilled hole in the presence of coupling liquid such as water, the capacitor bank is charged and the charge is then explosively released, generating sufficient energy to shatter or fracture the material around and below it. The explosive-like electrical detonation transmits energy in the form of shock waves into the rock formation with energy transmission being enhanced by means of the coupling fluid located in the bore hole along with the tool probe.

Many variations are possible within the basic concept. For example, a spark gap may be used instead of an initiating filament. Various types of material and designs of filaments can be used. The length of the probe can be shortened or lengthened within limits. The end of the probe can contain energy reflectors such as a paraboloid reflector to concentrate the shock wave in a desired area of the rock formation being fractured.

Other and further objects, advantages and features of the present invention will become apparent to one skilled in the art upon consideration of this entire disclosure. The form of the invention which will now be described in detail illustrates the general principles of the invention but it is to be understood that this detailed description is not to be taken as limiting the scope of the present invention.

BRIEF DESCRIPTION OF THE DRAWINGS

In order that the manner in which the above recited advantages and objects of the invention are obtained and can be understood in detail, more particular description of the invention, briefly summarized above, may be had by reference to the specific embodiments thereof that are illustrated in the appended drawings, which drawings form a part of the specification. It is to be understood however that the appended drawings illustrate only typical embodiments of the invention and therefore are not to be considered limiting of its scope, for the invention may admit to other equally effective embodiments.

IN THE DRAWINGS

Figure 2:
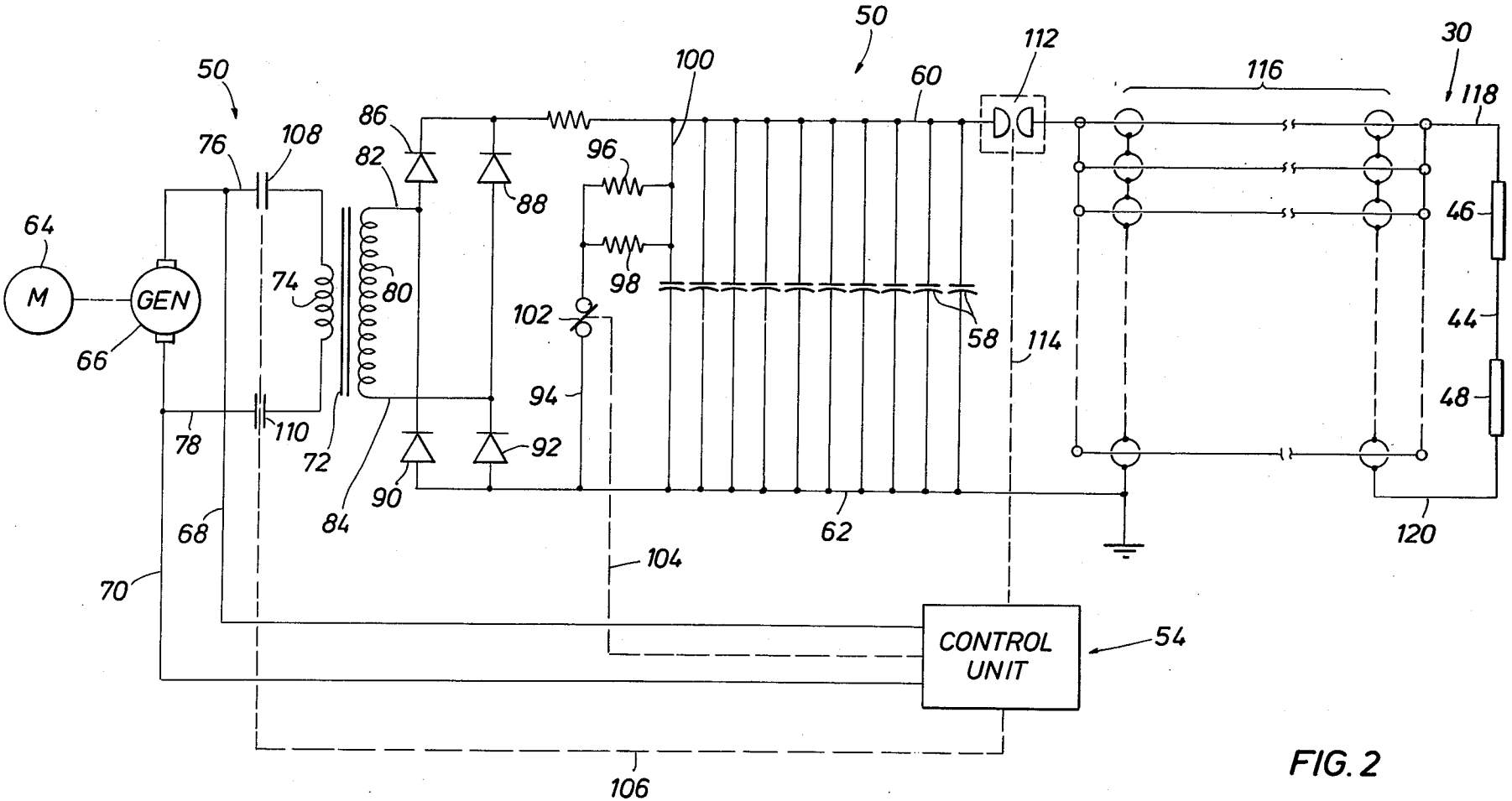

FIG. 1 is a pictorial representation of a portable trailer mounted rock fracturing machine constructed in accordance with the present invention.

FIG. 2 is a schematic electrical diagram of electrical rock fracturing circuitry which is capable of causing electrohydraulic fracturing of rock and other dense materials and which may be incorporated in the portable rock fracturing machine of FIG. 1.

FIG. 3 is a schematic illustration of a spark gap type explosive electrical discharge circuit representing a modified embodiment of the invention.

DETAILED DESCRIPTION OF PREFERRED EMBODIMENT

Theory

In the reflection theory, the discharge of an electrohydraulic pulse in a confined area such as a bore hole in a rock formation generates a compressive strain pulse, which travels through the rock in all directions from the point of discharge and decays in amplitude as it moves outward. The strain pulse continues to radiate until it is reflected by a free surface as a tensile strain pulse. The rock, being less resistant to tension than to compression, is pulled apart by the reflected tensile strain pulse.

The acoustic or shock wave theory suggests that the effective transfer of pressure to stress in the rock depends upon the impedance match between the explosion and the rock. A smaller explosion-to-rock impedance ratio should provide more effective transfer of pressure to stress-13 the simple elastic theory relations.

$$P_m = 2P/l - Z)$$

Where $P_m$ is the medium stress

P is detonation pressure

Z is explosion to rock impedance ratio.

The theory of elasticity shows that when shear-propagation velocity, longitudinal-propagation velocity, and density are known, all elastic constants can be calculated.

PRESSURE ESTIMATE, EXPLODING WIRE

Observed time for the luminous zone to achieve the terminal velocity of 9 km/sec is about 10 mu sec. The acceleration thus is:

$$a = \Delta V/\Delta_t = \frac{9 \times 10^3}{10 - 8} = 9 \times 10^{11} \text{m/sec}^2$$

For a mass of vapor of (10 ugm) the force is:

$$f = \text{ma} = (10 \text{ ugm}) \times 9 \times 10^{13} \text{cm} = 9 \times 10^9 \text{ dynes}$$

Assuming that the force acts over an area of $6 \times 10^{-3}$ $\text{cm}^2$ ($\frac{3}{4}$cm long $a_1$ 1 mil dia), the pressure is $P = 1.5 \times 10''$ dynes $\text{cm}^2 = 1.5 \times 10^5$ atmos.

Exploding element wires are best used with the probe, however, other means can be used. This gives controlled applications of electrical energy which can modify, direct or supplement the mechanical energy liberated by the discharge.

Referring now to the drawings and first to FIG. 1, a trailer monted rock fracturing machine is shown generally at 10 having a trailer frame 12 incorporating a towing tongue 14 and wheels 16 thereby enabling the trailer to be towed to any suitable site for effective use. On the trailer frame is supported a protective housing 18 providing weather protection for power generation and electrical power and control components located therein.

A connection element 20 is secured to the housing structure 18 and provides for a connection of an output cable 22 to the housing. The output cable is wound about a cable reeler mechanism 24 which is supported for rotation between the protective housing and towing tongue by means of upstanding support structures 26. The cable reeler 24 is rotated about a support axle 28 and may be mechanically powered or manually operated for reeling and unreeling of the output cable 22. The output cable will typically be on the order of 100 to 150 feet in length, thereby allowing workers to conduct rock fracturing operations within a perimeter of about 200 to 300 feet about the rock fracturing machine.

At the free extremity of the output cable 22 is provided a spark head assembly, illustrated generally at 30, which includes lifting handle elements 32 and 34 which extend upwardly from a support base 36. A connector element 38 secures the free extremity of the output cable 22 to the support base 36 and provides a protective housing for protection of electrical components therein. Immediately below the support base 36 a seal structure 40 is provided to prevent the liquid coupling fluid from passing through the support base and into the protective housing defined by the connector element 38. Also positioned below the support base 36 is a spark cage 42 which encloses an exploding wire filament 44 interposed between insulator elements 46 and 48.

In the process of fracturing surface rock vertical holes will be drilled into the rock a distance slightly exceeding the length of the spark cage 42. A coupling fluid such as water is poured into the shallow hole and the spark cage is then inserted into the hole thus positioning the support base 36 in contact with the surface of the rock. The exploding wire filament 44 is then electrically energized, developing a severe ablative electrical explosion thereby developing a sonic shock wave front in the coupling fluid. This shock wave front is transmitted directly into the rock formation about and below the spark cage, thus inducing fracturing of the rock responsive to development of a compressive strain pulse followed by a reflective tensile strain pulse which causes fracturing of the rock in tension.

Shown in broken line in FIG. 1 is a capacitor bank within the protective housing 18 of the trailer which stores electrical energy developed by a high voltage power supply 52 comprising a motor and generator assembly. The trailer mounted mechanism also incorporates a control unit 54 which controls operation of an output switch 56 which dumps the stored electrical energy of the capacitor bank 50 into the circuitry of the output cable 22.

Referring now to FIG. 2, electrical schematic circuitry is disclosed which may constitute the circuitry for the rock fracturing machine of FIG. 1 and which may have other suitable uses as well. For purposes of simplicity the circuitry of FIG. 2 is discussed in conjunction with the rock fracturing machine of FIG. 1 but it is to be borne in mind that this specific discussion is in no way limiting of the spirit and scope of the present invention.

The capacitor bank 50 incorporates a plurality of capacitors 58 which are connected in parallel across conductors 60 and 62. For example, each of the capacitors 58 may comprise 20 KV-15 MFD capacitors thereby defining a capacitor bank having an electrical energy storage capability on the order of 20 KV-50 KJ.

The capacitor bank 50 is charged by means of a power supply shown generally at 52 which incorporates a motor 64 of any suitable character in mechanically driving relationship with a generator 66. The generator develops an alternating current output which is coupled with power supply conductors 68 and 70 which provide a supply of alternating current for operation of the control unit 54. A transformer 72 is provided having its primary winding 74 coupled by conductors 76 and 78 to the outut of the generator 66. The secondary winding 80 of the transformer is coupled by conductors 82 and 84 to diodes 86, 88, 90 and 92 which form a bridge rectifier providing the conductors 60 and 62 with stepped up DC voltage. An energy dumping circuit 94 is coupled by parallel limiting resistors 96 and 98 across a conductor 100 which, in turn, couples a capacitor of the capacitor bank 50 across conductors 60 and 62. The dump circuit 94 incorporates a relay energized dump switch 102 which is connected by a control circuit 104 to the control unit 54. The circuitry of the control unit may be of any suitable character accomplishing controlled energization of the dump circuit 104 for operation of the relay controlled dumping switch 102. For example, the control circuit may incorporate sequentially firing circuitry which opens and closes the switch 102 in sequential manner to accomplish sequential electrohydraulic discharge at the exploding wire 44.

The control unit 54 also controls charging and discharging of the capacitor bank 50. A charging control circuit 106 is connected to the control unit 54 which accomplishes selective closure of generator output contacts 108 and 110 which ensure that the high voltage DC power supply connected to the output winding of the transformer remains deenergized until the contacts 108 and 110 are closed. The control unit may incorporate a suitable power control relay which induces closure of the contacts 108 and 110 through activation of circuit 106. An output switch 112 is coupled with the conductor 60 and is selectively opened and closed by the control unit 54 under the control of an output switch conductor 114. The output switch 112 may be controlled by a suitable relay incorporated within the control unit. The control unit is simply illustrated in block diagram form since it may incorporate any number of control circuits of any desired character for accomplishing the control activities described above.

The bracketed circuit portion 116 of FIG. 2 represents the output cable and cable reeler assembly shown in FIG. 1. The spark head 30 incorporates supply conductors 118 and 120 which are coupled respectively to the exploding wire insulators 46 and 48.

As mentioned above, the explosive electrical discharge may be created by an exploding wire filament such as shown at 44 or by means of an electrical spark which is generated across a spark gap. As shown in FIG. 3, electrodes 122 and 124 define a spark gap 126 and are coupled by power supply conductors 128 and 130 to the capacitor bank shown generally at 132. Again the capacitor bank incorporates a plurality of parallel coupled capacitors 134 similar to the arrangement of FIG. 2. The electrical spark generated at the spark gap will be greatly enhanced if the spark gap is subjected to preliminary preparation to break down its resistance and render it conductive. Accordingly, an injection circuit 136 is provided having series coupled capacitors 138 which have the function of increasing the main capacitor bank voltage to an injector level. A spark gap switch 140 is provided which is activated by a solenoid 142 and which is closed to couple the injector circuit 136 to a firing circuit 144. An ignitron switch 146 is coupled to the power supply conductor 130. The ignitron switch 146 is fired after preparation of the spark gap 126 to accomplish sudden dumping of the stored electrical energy of the capacitor bank into the prepared spark gap. The spark gap switch 140 is first exhausted by energizing the solenoid valve 142, allowing the spark gap to be selectively pressurized or depressurized as is appropriate for spark ignition. When the spark gap is depressurized, the series injection capacitors 138, which can be on the order of 8 microfareds each, are discharged, causing a voltage to appear across the electrodes 122 and 124. This voltage for example may be on the order of 30 kilovolts. When the voltage across the electrodes causes the spark gap to break down, the ignitron switch 146 is then caused to fire, unloading the main capacitor bank 132 into the developed spark channel 126. Thus the stored energy of the capacitor bank is suddenly unloaded intothe spark channel during a short or substantially instantaneous period of time, such as about 10 microseconds, for example, which enters the already developed spark channel and develops a violent, ablative explosion that is transmitted through the coupling fluid to the surrounding rock formation. If desired, the spark explosion at the spark gap 126 may be repeatedly pulsed as many times as necessary for complete fracturing of the rock or other dense material surrounding the coupling fluid. Any suitable repetitive pulsing circuit may be incorporated to achieve sequential recharging of the capacitor bank and discharging its energy across the spark gap. The power supply for the circuitry of FIG. 3 may take the form generally shown in FIG. 2.

Supplemental Information

Investigations have indicated that the peak current shows a correlation with explosive intensity and shock wave velocity. There is established therefore a relationship between peak currents and systems properties so the performance of the configuration and a given mass of wire can be estimated. If follows therefore that optimum energy determination can be established and can be demonstrated that KJ energy converted to the mass of a given material develops a maximum shock wave. It also follows that the power required for optimum energy conversion of, for example, an 18 mil wire, is in the order of 12 to 14 KJ or equal to ⅓ stick blasting powder. In order to equal the explosive energy released by 8 oz. of dynamite, 36 KJ and 0.07 oz. of tungsten wire is required. It follows therefore that a 2000 KJ capacitor bank should suffice for 5 holes if delay electrohydraulic blasting is employed.

Any curved longitudinal wave front, either convex or concave, being propagated through dense material, generates a tensile or compressive stress tangential to the front. The magnitude of this tangential or hoop stress is directly proportional to the longitudinal stress normal to the wave front, and inversely proportional to the radius of curvature of the front. For a spherically expanding compressive wave front the hoop stress will be of tensile character. If the hoop stress is greater than the tensile strength of the material, radial fractures will occur. For values of hoop stress greater than the tensile strength of the rock material many fractures will develop. The resultant fracture patterns are regular and the radial fractures are evenly spaced.

Grain boundaries are particularly vulnerable elements within rock formations from the standpoint of fracture. At such boundaries the mechanical properties of the rock mass change abruptly. Such boundaries in mechanical properties have a marked effect on an advancing stress wave, transforming it and leading to the generation of destructive stresses.

In addition, when the advancing wave front is parallel to the boundary, the wave front advances at different velocities in the two juxtaposed materials and will generate a tendency to tear the boundary apart. The interactions of the interface are extremely complex and an exact and precise treatment of the problem is almost impossible. Even the most elementary of qualitative considerations will shown that an interface of rock masses is subject to fracture when strong shearing and tangential forces are applied.

Although, for the most part, the explosive electrical discharge apparatus of FIGS. 1, 2 and 3 has been discussed in specific conjunction with fracturing of in situ rock formations, it should be borne in mind that the apparatus may take many other suitable forms and may have many other uses within the spirit and scope of this invention. These specific discussions are therefore not intended to limit the invention in any manner whatever. For example, apparatus incorporating the method of this invention may be employed in the cleaning of heat exchanger tubes in boilers and other apparatus. Deposits of dense material in tubes, pipes and the like may be effectively removed by extending an electrohydraulic probe therein of sufficient flexibility to accommodate 180° reverse tube bends. The probe is then passed through the heat exchanger tubes while continuously discharging electrohydraulic energy. The dense deposits will be fractured or pulverized and can simply be flushed from the tubes or pipes.

Cleaning of internal deposits in valves and pipelines may be accomplished in the same manner as described above but through application of significantly greater electrohydraulic energy in larger sizes thereof. The energy may also be applied through the wall structure of the pipe.

Downhole applications in wells may take many different forms. Well screening and perforations may be cleaned by electrohydraulic shock energy. Deposits of certain materials in production tubing, well casing and the like may also be removed. Downhole mechanical apparatus such as safety valves may be cleaned of deposits that interfere with proper operation thereof by electrohydraulic shock treatment.

Cleaning of castings may be accomplished through removal of dense core materials by electrohydraulic shock energy.

In certain engineering projects requiring removal of pipe from hardened material an electrohydraulic shock probe can be inserted into a pipe in order to separate material from both the inside and outside of the pipe. In the latter case the shock wave is directed toward the internal walls of the pipe and is transmitted through the pipe to pulverize fracturable material and release the pipe from its containment. In such case, the diameter of the pipe can range from less than 1" to as much as 72". By employing an encircling type shock wave generation device, material clogging a pipe can be released in an effective and efficient manner by shock waves transmitted through the pipe to the obstructing material. The energy transmitting device can be operated from any suitable power source at the working site or may be provided with its own power supply 52. The capacitor bank 50 can then be charged by the power supply and discharged from control unit 54 through cable 22 to tool 30 which will be properly coupled to the formation to facilitate transmission of electrohydraulic shock waves into the formation for fracture thereof.

In view of the foregoing, it is apparent that I have developed a method and apparatus for accomplishing in situ fracturing of dense materials such as rock, fracturable sediment and deposits, etc. The apparatus that I have developed may be efficiently incorporated in a portable system thereby adapting it for efficient use in field conditions such as for in situ fracturing of surface rock during excavation and construction operations. It is therefore seen that my invention is one well adapted to attain all of the objects and advantages hereinabove set forth together with other advantages which will become obvious and inherent from a description of the apparatus itself. It will be understood that certain combinations and subcombinations are of utility and may be employed without reference to other features and subcombinations. This is contemplated and is within the scope of the present invention.

What is claimed is:

1. A method for in situ fracturing of dense materials such as rock and the like, comprising:

(a) forming a confined receptacle having said dense materials forming a surface thereof;

(b) placing a hydraulic coupling medium within said confined receptacle;

(c) locating an exploding element wire within said confined receptacle and coupling medium, said exploding element wire being in circuit with capacitor means; and (d) inducing an explosive electrical discharge in the hydraulic coupling medium in close proximity to the dense material by discharging capacitor voltage across said exploding element wire thus developing a shock wave in the hydraulic coupling medium which is transmitted by the hydraulic coupling medium into the dense material as an advancing compressive strain pulse which radiates from the explosive electrical discharge through the dense material until it is reflected by a free surface as a tensile strain pulse, said tensile strain pulse being impedance matched with the dense material such that said tensile strain pulse induces in situ fracturing of the dense material.

2. The method as recited in claim 1, wherein:

the impedance match between the explosive electrical discharge and the dense material is calculated according to the equation:

$$P_m = 2P/(l-Z)$$

where $P_m$ is the stress of the dense material;

P is the detonation pressure of the explosive electrical discharge; and

Z is the impedance ratio of the explosion to the dense material.

3. The method as recited in claim 1, wherein inducing an explosive electrical discharge in the hydraulic coupling medium comprises:

(a) positioning electrical discharge apparatus in said confined receptacle in such position that the explosive hydraulic wave front generated by the electrical discharge apparatus is directed at said dense material;

(b) introducing electrical energy into a capacitor bank until it reaches a predetermined charge; and (c) suddenly discharging the stored electrical energy of said capacitor bank across said exploding element wire.

4. A method for in situ fracturing of dense materials such as rock and the like, comprising:

(a) forming a confined receptacle having said dense materials defining a surface thereof;

(b) placing a hydraulic coupling medium in said confined receptacle and in intimate contact with said surface of said dense materials;

(c) locating electrodes within said confined receptacle and hydraulic coupling medium, said electrodes being spaced to define a spark gap and being electrically coupled to capacitor means;

(d) subjecting said spark gap to an injection voltage to render it conductive; and (e) suddenly discharging said capacitor means across the conductive spark gap thus developing an explosive electrical discharge across said spark gap and developing an electrohydraulic shock wave in said hydraulic coupling medium in close proximity to said surface of said dense materials as an advancing compressive strain pulse which radiates from the explosive electrical discharge through the dense material until it is reflected by a free surface as a tensile strain pulse, said tensile strain pulse being impedance matched with the dense material such that said tensile strain pulse induces in situ fracturing of the dense material.

5. The method of claim 4, including:

subjecting said spark gap to a predetermined pressure condition prior to discharge of said stored electrical energy therein to enhance the explosive oblative nature of the explosive spark developed in said spark gap.

* * * * *